United States Patent [19]

Neyhart et al.

[11] 4,286,033

[45] Aug. 25, 1981

[54] TRAPPING LAYER OVERCOATED INORGANIC PHOTORESPONSIVE DEVICE

[75] Inventors: James H. Neyhart; George A. Brown, both of Penfield; Lloyd A. Relyea, Webster; Merlin E. Scharfe; Heinz W. Pinsler, both of Penfield, all of N.Y.

[73] Assignee: Xerox Corporation, Stamford, Conn.

[21] Appl. No.: 127,177

[22] Filed: Mar. 5, 1980

[51] Int. Cl.[3] ..... G03G 5/082; G03G 5/14

[52] U.S. Cl. ..... 430/58; 430/57; 430/60; 430/63; 430/66; 430/67

[58] Field of Search ..... 430/57, 58, 60, 63, 430/67, 66

[56] References Cited

U.S. PATENT DOCUMENTS

| | | | |
|---|---|---|---|
| 3,355,289 | 11/1967 | Hall et al. | 430/57 X |
| 3,635,705 | 1/1972 | Ciuffini | 430/57 |
| 3,655,377 | 4/1972 | Sechak | 430/57 |
| 3,704,121 | 11/1972 | Makino et al. | 430/57 |
| 4,050,935 | 9/1977 | Limburg et al. | 430/58 X |
| 4,123,269 | 10/1978 | Von Hoene et al. | 430/60 |
| 4,202,937 | 5/1980 | Fukuda et al. | 430/58 |

FOREIGN PATENT DOCUMENTS

| | | | |
|---|---|---|---|
| 2061655 | 6/1972 | Fed. Rep. of Germany | 430/57 |

*Primary Examiner*—Roland E. Martin, Jr.

*Attorney, Agent, or Firm*—E. O. Palazzo

[57] ABSTRACT

This invention is generally directed to inorganic overcoated photo-responsive devices comprised of a substrate, a layer of hole injecting material capable of injecting holes into a layer on its surface, this layer being comprised of trigonal selenium, a hole transport layer in operative contact with the hole injecting layer, this layer being comprised of a halogen doped selenium arsenic alloy, wherein the percentage by weight of selenium present is from about 99.5 percent to about 99.9 percent, the percentage by weight of arsenic present is from about 0.1 percent to about 0.5 percent, and the halogen is present in an amount of from about 10 parts per million, to about 200 parts per million; a charge generating layer overcoated on the hole transport layer, comprised of an inorganic photoconductive material; a hole trapping layer overcoated on the generator layer, the trapping layer being comprised of a halogen doped selenium arsenic alloy, containing from about 95 percent selenium, to 99.9 percent selenium, from about 0.1 percent to about 5 percent of arsenic and 10 parts per million to 200 parts per million of a halogen material, and a layer of insulating organic resin overlaying the charge generating layer. This device is useful in an electrophotographic imaging system using in a preferred embodiment a double charging sequence, that is, negative charging, followed by positive charging.

4 Claims, 4 Drawing Figures

TRAPPING LAYER OVERCOATED INORGANIC PHOTORESPONSIVE DEVICE

BACKGROUND OF THE INVENTION

This invention is generally directed to a photoresponsive imaging device, and more specifically, to overcoated inorganic photoresponsive devices, which contains a trapping layer, and the use of such devices in electrophotographic imaging systems.

The formation and development of images on the imaging surfaces of photoconductive materials by electrostatic means is well known, one of the most widely used processes being xerography as described in U.S. Pat. No. 2,297,691. Numerous different types of photoreceptors can be used in the electrophotographic process such photoreceptors including inorganic materials, organic materials and mixtures thereof. Photoreceptors are known wherein the charge carrier generation and charge carrier transport functions are accomplished by discrete contiguous layers. Also known are photoreceptors which include an overcoating layer of an electrically insulating polymeric material, and in conjunction with this overcoated type photoreceptor there have been proposed a number of imaging methods. However, the art of electrophotography and more specifically, xerography, continues to advance and more strigent demands need to be met by the copying apparatus in order to increase performance standards, obtain higher quality images, and further to act as protection for the photoreceptor as well as to control the manner and the type of charges that are transported and retained at various levels of the photoreceptor device.

In one known process using overcoated photoreceptor devices there is employed a non-ambipolar photoconductor wherein charge carriers are injected from the substrate electrode into the photoconductor surface. In such a system in order to obtain high quality images the injecting electrode must satisfy the requirements that it injects carriers efficiently and uniformly into the photoconductor. While these devices function properly and adequately there continues to be a need for improved photoreceptor devices which contain a trapping layer thus allowing the production of images of high quality over a long period of time. A method for utilizing organic overcoated photoreceptor devices has been recently discovered and is described in copending application, U.S. Ser. No. 881,262, filed on Feb. 24, 1978 on Electrophotographic Imaging Method, Simpei Tutihasi, Inventor. In the method described in this application there is utilized an imaging member comprising a substrate, a layer of charge carrier injecting electrode material, a layer of a charge carrier transport material, a layer of a photoconductive charge carrier generating material and an electrically insulating overcoating layer. In one embodiment of operation the member is charged a first time with electrostatic charges of a first polarity, charged a second time with electrostatic charges of a polarity opposite to the first polarity in order to substantially neutralize the charges residing on the electrically insulating surface of the member and exposed to an imagewise pattern of activating electromagnetic radiation whereby an electrostatic latent image is formed. The electrostatic latent image may then be developed to form a visible image which can be transferred to a receiving member. Subsequently, the imaging member may be reused to form additional reproductions after the erasure and cleaning steps have been accomplished. The actual operation of this member is best illustrated by referring to the figures which are part of the present application and more specifically, FIGS. 2A and 2C.

An inorganic photoresponsive device using the above-mentioned process for forming images is described in copending application, filed concurrently herewith such copending application being identified by U.S. Ser. No. 127,176, filed Mar. 5, 1980, on Overcoated Inorganic Layered Photoresponsive Device and Process of Preparation, the subject matter of such application being totally incorporated herein by reference.

SUMMARY OF THE INVENTION

It is an object of the present invention to provide an improved inorganic layered photoreceptor device.

Another object of the present invention is the provision of a photoresponsive device containing a trapping layer, which layer prevents charges from migrating from the interface between the generating layer and the overcoating insulating layer to the injecting electrode, so as to improve image quality, and reduce dark decay, as well as improve cyclability of the photoreceptor device.

These and other objects of the present invention are accomplished by providing a layered inorganic photoresponsive device which contains a trapping layer. More specifically, the present invention is directed to a layered inorganic photoresponsive device, which can be used in various imaging systems, such as electrophotographic systems, this device being comprised of a substrate, or supporting base, containing on its surface a layer of hole injecting material comprised of trigonal selenium, a hole transport layer in operative contact with the hole injectin layer, the transport layer being comprised of a halogen doped selenium arsenic alloy, wherein the percentage by weight of selenium present is from about 99.5 percent to about 99.9 percent, the percentage by weight of arsenic present is from about 0.1 percent to 0.5 percent, a charge generating material overcoated on the transport layer, this material being comprised of inorganic photoconductive substances, a trapping layer overcoated on the generating layer, and as a protective layer, a layer of insulating inorganic resin overlaying the charge generating layer. About 10 parts per million to about 200 parts per million of halogen material is present, in the transport layer.

While various hole trapping layers can be used with the inorganic photoresponsive device of the present invention, including for example, selenium, selenium arsenic alloys, and other various inorganic photoconductive materials, the trapping layer of the present invention is comprised of a halogen doped selenium arsenic alloy wherein the percentage by weight of selenium ranges from about 95 percent, to about 99.9 percent, and preferably from about 99 percent to about 99.9 percent, with the precentage of arsenic by weight varying from about 0.1 percent to about 5.0 percent, the halogen being present in amounts of from about 10 parts per million to 200 parts per million and preferably from 20 parts per million to 100 parts per million. By halogen materials is meant fluorine, chlorine, bromine, and iodine, with chlorine being preferred. The hole trapping layer composition is substantially similar to the transport layer, and in some instances both layers can be comprised of the same materials.

The hole trapping layer which is between the generating layer and the overcoating insulating layer is of importance since if the holes, that is, positive charges, are not substantially retained at the interface between the above two mentioned layers, the efficiency of the photoreceptor device is adversely affected when such holes are allowed to freely migrate back to the generator layer. If some of the holes are allowed to migrate they will travel towards the electrode layer, and neutralize the negative charges located between the hole injecting layer and the transport layer thus reducing the overall voltage useful for this succeeding imaging process. This would adversely affect the imaging system as well as lower the efficiency of the device and render the cyclic characteristics of such device unstable. It is important to note that the device is operative without the trapping layer, however, depending upon the amount and the frequency with which the holes travel throughout the system, the amount of holes retained at the generator insulator interface varies resulting in cyclic unstability. The photoresponsive device may remain photosensitive without the trapping layer, however, higher initial fields will be needed in order to render the device efficient; the disadvantage of using higher fields is that it causes breakdown in the system, and more ozone is generated, thus posing an environmental problem in some situations. It is preferable to use lower voltages as this is more efficient and more stable and further with the hole trapping layer the dark decay of the system, that is, leakages of charges, will improve significantly so as to substantially reduce dark decay.

The thickness of the hole trapping layer ranges from about 0.01 microns to about 5 microns, and preferably from about 0.01 micron to about 1 micron. The minimum thickness of the hole trapping layer may be less, or more, however, it must be of sufficient thickness so as to provide for sufficient trapping of holes at the overcoating interface. The maximum thickness is determined by the amount of light absorption in the trapping layer. Ideally, it is desirable to have substantially all the light absorbed in the highly sensitive generator layer (Se-Te). Trapping layers such as selenium alloys absorb much of the light (the amount depending on thickness and the wavelength). Photogeneration of mobile carriers (holes) is less efficient in the trapping layer than in the generator layer, thus, sensitivity is reduced. Accordingly, it is desirable to provide a thin trapping layer, as thin as possible, consistent with efficient trapping of the injected holes coming from the rear of the structure.

The trapping layer can be prepared by many different methods, In one method, there is used a separate crucible within a vacuum coater containing a small quantity of the desired selenium arsenic-alloy, whose weight has been previously calibrated to give the desired thickness of trapping layer. Following formation of the generator layer, the alloy material is evaporated using a specified time/temperature program. A typical program might involve 5 minutes evaporation during which the crucible temperature is increased from 80° C. to 415° C.

In another embodiment the following method was used to prepare the trapping layer. Subsequent to formation of the injecting layer, the crucible from which the selenium was completely evaporated to form the injecting layer is allowed to partially cool, and is maintained a a constant soak temperature (typical 80° C.). This temperature is sufficiently low to allow a small quantity of the transport layer vapors which are subsequently formed during transport layer formation to deposit on the injection layer crucible. Following the generator layer formation the temperature of, the injector boat on which a small quantity of transport layer material has condensed, is increased from about 80° C. to about 415° C. in about 4 minutes, and the condensate reevaporates. The reevaporated material deposits on top of the generator layer to form the top coat trapping layer.

The above device comprised of a substrate, overcoated with an injecting layer of trigonal selenium, which in turn is overcoated with the transport layer indicated, the transport layer containing a generating layer thereover, containing a trapping layer on its surface can then be overcoated with an insulating organic resin layer. Typically, a layer having a thickness of from about 5 microns to about 25 microns of a polyurethane resin is deposited by solution spray coating, although other resins and other techniques of resin deposition may be used.

In one preferred embodiment of the present invention, the substrate is a conductive material, such as aluminum, the hole injecting layer is trigonal selenium, the hole transport layer is a halogen doped selenium arsenic alloy, containing 99.5 to 99.9 weight percent of selenium, 0.1 to 0.5 weight percent of arsenic, 50 parts per million to 100 parts per million of halogen, the charge generating layer is a selenium tellurium alloy, the hole trapping layer is a halogen doped selenium arsenic alloy as defined herein, and the overcoating layer is a polyester or polyurethane material.

In one embodiment the trigonal selenium hole injecting material can be prepared by sequential layer deposition in a vacuum coater of trigonal selenium onto a supporting substrate. A trigonal selenium layer can be formed on the top of the metal substrate by thermal conversion from vapor deposited selenium. The transport layer is then overcoated on the trigonal selenium injecting layer, followed by coating the generating layer on the transport layer, with the trapping layer then being coated on the generating layer and optionally an organic insulating resin layer is overcoated on the trapping layer, as indicated herein. Generally a strong bond is formed between the hole injecting layer and the substrate, and the hole injecting layer and the transport layer. Depending on the type of photoreceptor device desired the process conditions can vary accordingly.

The substrate, which is comprised in one embodiment of a flexible high purity aluminum sheet usually has to be treated in order that initiation of the crystallization of high purity selenium can occur. Thus, for example, aluminum sheet which is highly polished, is abraded with Scotch Brite until a matte finish is obtained, followed by etching with an Efferal solution. In another embodiment, when a rigid cylindrical drum is used as the substrate, the aluminum drum is first subjected to a mild caustic ethc using a known mixture of trisodium phosphate, sodium carbonate and water. Additionally, prior to use, a further etching with an Efferal solution can be employed.

Subsequent deposition of the transport and generation layers is conducted in a vacuum chamber, e.g. a 24 inch vacuum coater, well known in the art. Heating of the substrate during the deposition is preferably accomplished using a temperature controlled mandrel in contact with the rear of the substrate. This mode of heating (in distinction, for instance, to glow discharge heating) minimizes additional oxide formations on the etched aluminum surface and allows better control of the substrate temperature during the entire photoconductor evaporation process.

The trigonal selenium injecting layer which is in operative contact with the substrate such as an aluminum sheet is prepared, as indicated herein, by evaporating a weighed amount of high purity selenium from a separate boat. The weighed amount will be dependent on the specific vacuum coater configuration but is calibrated to yield the desired thickness, as indicated hereinafter of trigonal selenium. The substrate temperature during this evaporation is ideally maintained at about 95 to about 120° C. The selenium evaporation rate is adjusted in order that the rate of condensation of vapors on the substrate is not greater than the rate of conversion of amorphous to crystalline selenium at the substrate temperature, since this insures that the crystalline injector trigonal selenium layer is formed simultaneously upon contact. If an amorphous layer is allowed to deposit followed by slow conversion to the crystalline form there may result serious reduction in hole injection efficiency and/or reduction in the adhesion of the layer to the substrate.

The transport layer which is comprised of a halogen doped selenium arsenic alloy is evaporated by current state-of-the-art techniques in order to result in layer of the desired thickness, as described hereinafter, for example up to about 60 microns in one embodiment. The amount of alloy present in the evaporation boats will depend on the specific coater configuration and other process variables, but is calibrated to yield the desired transport layer thickness. Chamber pressure during operation is of the order of less than $4\times10^{-5}$ torr. Evaporation can be completed over a period of time which ranges from about 15 minutes to about 22 minutes, during which time the temperature of the crucible containing the molten alloy increases from 15° C. to about 200° C. Other times vs. temperatures outside these ranges are also useable as will be understood by those skilled in the art. During deposition of the transport layer it is desirable that the substrate temperature be maintained in the range of from about 60° C. to about 80° C. (degrees centigrade).

The generating layer which is comprised in one embodiment of an alloy of selenium tellurium, 75 percent to 80 percent selenium, and 20 percent to 25 percent tellurium, is prepared by grinding the selenium tellurium alloy, and preparing pellets from the ground materials so as to result in a layer of the desired thickness as indicated herein, for example, in one embodiment up to 5 microns. The pellets are evaporated from crucibles using a time/temperature crucible program designed to minimize the fractionation of the alloy during evaporation. In this manner the concentration of tellurium across the generating layer can be maintained reasonably close to the composition of the pellets (a "flat" tellurium profile). A typical crucible program for this step will form a 0.6 micron generating layer in 12–15 minutes, during which time the crucible temperature is increased from 25° C. to 385° C.

In some instances deviation of the surface tellurium content above and below 25 percent will result in higher and lower photoresponsive sensitivity and corresponding higher or lower dark decay rates.

In one preferred method of operation the above described layered photoreceptor device is charged a first time with electrostatic charges of a negative charge polarity, subsequently charged a second time with electrostatic charges of a positive polarity for the purpose of substantially neutralizing the charges residing on the electrically insulating surface of the member, and subsequently exposing the member to an imagewise pattern of activating electromagnetic radiation thereby forming an electrostatic latent image. This image can then be developed to form a visible image which is transferred to a receiving member. The imaging member may be subsequently reused to form additional reproduction after the erase and cleaning steps have been accomplished.

BRIEF DESCRIPTION OF THE DRAWINGS

For a better understanding of the present invention and further features thereof reference is made to the following detailed description of various preferred embodiments wherein.

DESCRIPTION OF THE PREFERRED EMBODIMENTS

Figure 1:
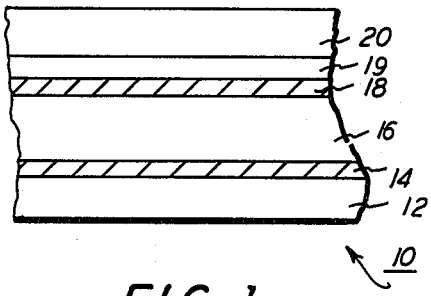
FIG. 1 is a partially schematic cross-sectional view of the layered photoreceptor device of the present invention.

Illustrated in FIG. 1 is a photoreceptor device generally designated 10, comprising a substrate layer 12, overcoated with a hole injecting layer 14, comprised of trigonal selenium, which in turn is overcoated with a transport layer 16, which is comprised of a halogen doped selenium arsenic alloy as defined herein, which layer in turn is overcoated with a generating layer 18, comprised of inorganic photoconductive substances, such as alloys of selenium tellurium, which in turn is overcoated with a hole trapping layer 19, and finally an overcoating layer 20 of an insulating organic resin such as a polyurethane or polyester.

Substrate layer 12 may comprise any suitable material having the requisite mechanical properties, thus for example, this substrate can be comprised of a layer of an organic or inorganic material having a conductive surface layer thereon, or conductive materials such as aluminum, nicke, and the like. One of the primary purposes of the substrate layer is for support and systems can be envisioned where the substrate might be dispensed with entirely. The thickness of the substrate layer, which in some instances can be an optional layer, is dependent upon many factors including economic considerations, and design of the machine within which the photoresponsive device is to be used. Thus this layer may be of substantial thickness for example up to 200 mils, or of minimum thickness, that is approximately 5 mils, provided there are no adverse effects on the system. Generally, however, the thickness of this layer ranges from about 5 mils to about 100 mils. The substrate can be flexible, or rigid, and may have many different configurations, such as for example, a plate, a cylindrical drum, a scroll, an endless flexible belt, and the like.

The hole injecting layer 14, which is comprised of trigonal selenium, injects charge carriers or holes into layer 16 under the influence of an electrical field. The injected charge carriers should be of the same polarity as the mobile carriers transported by the transport layer, layer 16, during the imaging process. The thickness of the trigonal selenium layer ranges from about 0.5 microns to about 10 microns and preferably from about 1 micron to about 5 microns. The minimum and maximum thickness of this layer is generally determined by the electrical properties desired, and it is not intended to be limited to the specific thickness disclosed. Also the charge carrier (hole) injecting layer, and the charge carrier transport layer require a particular work function relationship in order that the holeinjection from the former into the latter can be effectively accomplished, while minimizing the injection of the opposite sign carriers.

The transport layer 16 is comprised of a halogen doped selenium arsenic alloy wherein the percent of selenium present ranges from about 99.5 percent to about 99.9 percent and the percentage of arsenic present ranges from about 0.1 percent to about 0.5 percent. The amount of halogen, chlorine, fluorine, iodine, or bromine present ranges from about 10 parts per million to about 200 parts per million, with the preferred range being from about 50 parts per million, to about 100 parts per million. The preferred halogen is chlorine. Thus, for example, while other alloys have cyclic residual potentials of 200 volts or more after 1,000 copy cycles in an electrophotographic system, with the alloy of the present invention residuals of zero (0) to 25 volts result after the same number of cycles. This layer generally ranges in thickness from about 5 to about 60 microns and preferably from about 25 microns to about 50 microns. Other inorganic photoconductors can be used for this layer including for example amorphous selenium, various other selenium alloys including selenium tellurium, arsenic sulfur selenium, selenium doped with various halogen materials, and other suitable panchromatic inorganic substances.

The inorganic photoconductive generating layer 18 in one embodiment is comprised of a selenium tellurium alloy, with the percentage of selenium being from about 70 percent to about 90 percent and the percentage of tellurium being from about 10 percent to about 30 percent. Preferably about 75 percent of selenium, and 25 percent of tellurium, is present in the generating layer 18. This layer ranges in thickness of from about 0.1 micron to about 5 microns, and preferably from 0.2 to about 1 micron. The generating layer generally is of a thickness which is sufficient to absorb at least 90% or more of the incident radiation which is directed upon it in the imagewise exposure step.

The electrically insulating overcoating layer 20 is generally from about 5 to about 25 microns in thickness, and preferably from about 12 to about 18 microns in thickness. Generally this layer provides a protective function, in that the photoconductive material surface is kept from being contacted by toner and ozone which is generated during the imaging cycles, and from physical damage from scratching and the like. The overcoating layer also prevents corona charges from penetrating through it into the charge generating layer 18 or from being injected into it by the latter. Preferably therefore, layer 20 comprises materials having high resistance to charge carrier injection and low carrier mobilities. The minimum thickness of this layer is determined by the function the layer must provide, whereas the maximum thickness is determined by mechanical considerations and the resolution capability desired for the photoresponsive device. Typical suitable overcoating materials include polyethylenes, polycarbonates, polystyrenes, polyesters, polyurethanes, and the like, with polyurethanes commercially available from Mobil Corporation or Kansai Paint Company, and polyesters commercially available from Goodyear Chemical Company being the preferred overcoating layer.

The formation of the insulating layer over the charge generating layer may be accomplished by any one of several methods known in the art such as spraying, dipping, roll coating and the like, by which a solution of one layer material is applied. By evaporation of the solvent, a hard resistive layer is left. Non-solution methods may also be used.

Figure 2A:
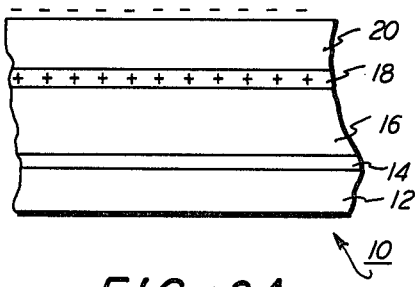
FIGS. 2A to 2C illustrate the imaging steps employed.
Figure 2B:
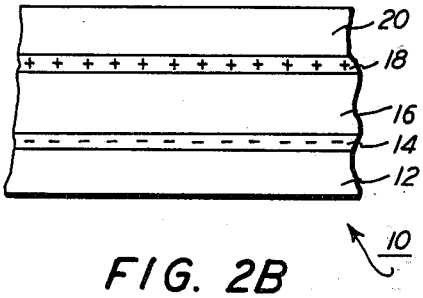
Figure 2C:
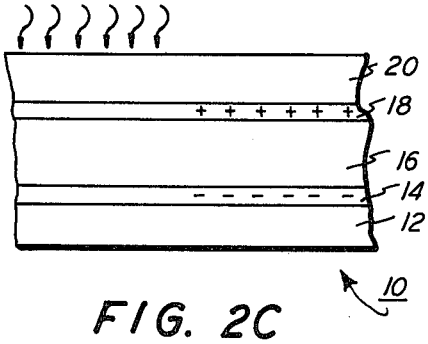

The operation of the member of the present invention is illustrated in FIGS. 2A–2C. In this illustrative explanation the initial charging step is carried out with negative polarity. As noted previously, the method is not limited to this embodiment. Moreover, the description of the method will be given in conjunction with a proposed theoretical mechanism, by which the method is thought to be operative, in order to better aid those skilled in the art to understand and practice the invention. It should be noted, however, that the method has been proved to be operable and highly effective through actual experimentation and any inaccuracy in the proposed theoretical mechanism of operation is not to be construed as being limiting of the invention.

Referring to FIG. 2A, there is seen the condition of the photoreceptor after it has been electrically charged negatively a first time, uniformly across its surface in the absence of illumination, by any suitable electrostatic charging apparatus such as a corotron. The negative charges reside on the surface of electrically insulating layer 20. As a consequence of the charging an electrical field is established across the photoreceptor, and as a consequence of the electrical field and the work function relationship between layers 14 and 16, holes are injected from the charge carrier injecting layer into the charge carrier transport layer. The holes injected into the charge carrier transport layer are transported through the layer, enter into the charge carrier generating layer 18 and travel through the latter until they reach the interface between the charge carrier generating layer 18 and the electrically insulating layer 20, where they become trapped, by trapping layer 19. The charges thus trapped at the interface establish an electrical field across the electrically insulating layer 20. Thus, it is seen that in the embodiment where negative charging is carried out in the first charging step, charge carrier injecting layer 14 and charge carrier transport layer 16 must comprise materials which will allow injection of holes from the former into the latter. Also, the charge carrier transport layer 16 and the charge carrier generating layer 18 allow injection of holes from the former into the latter, and allow the holes to reach the interface between layer 18 and electrically insulating layer 20.

Subsequently, the member is charged a second time, again in the absence of illumination, with a polarity opposite to that used in the first charging step in order to substantially neutralize the charges residing on the surface of the member. In this illustrative instance, the second charging of the member is with positive polarity. After the second charging step the surface of the photoreceptor should be substantially free of electrical charges. The substantially neutralized surface is created by selecting a charging voltage, such that the same number of positive charges are deposited as negative charges previously deposited. By "substantially neutralized" within the context of this invention is meant that the voltage across the photoreceptor member, upon illumination of the photoreceptor, is substantially zero.

FIG. 2B illustrates the condition of the photoreceptor after the second charging step. In this illustration no charges are shown on the surface of the member. The positive charges residing at the interface of layers 18 and 20 as a result of the first charging step remain trapped at the interface, at the end of the second charging step. However, there is now a uniform layer of negative charges located at the interface between layers 14 and 16.

Therefore the net result of the second charging step is to establish a uniform electrical field across the charge carrier transport and charge carrier generating layers. To achieve this result it is critical that the negative charges be located at the interface between charge carrier injecting layer 14 and charge carrier transport layer 16, and be prevented from entering into and being transported through the transport layer. For this reason it is mandatory to utilize a charge carrier transport material which will allow injection of only one species of charge carrier, namely, holes in this illustrative instance. This is especially necessary when a charge carrier transport material is used which is capable of transporting both species of charge carriers.

Subsequently, reference FIG. 2C, the member is exposed to an imagewise pattern of electromagnetic radiation to which the charge carrier generating material comprising layer 18 is responsive. The exposure of the member may be effected through the electrically insulating overcoating. As a result of the imagewise exposure an electrostatic latent image is formed in the photoreceptor. This is because hole electron pairs are generated in the light-struck areas of the charge carrier generating layer. The light-generated holes are injected into the charge carrier transport layer and travel through it to be neutralized by the negative charges located at the interface between layers 14 and 16. The light-generated electrons neutralize the positive charges trapped at the interface between layers 18 and 20. In the areas of the member which did not receive any illumination, the positive charges remain in their original position. Thus, there continues to be an electrical field across the charge carrier transport and charge carrier generating layers in areas which do not receive any illumination, whereas the electrical field across the same layers in the areas which receive illumination is discharged to some low level (FIG. 2C).

The electrostatic latent image formed in the member may be developed to form a visible image by any of the well-known xerographic development techniques, for example, cascade, magnetic brush, liquid development and the like. The visible image is typically transferred to a receiver member by any conventional transfer technique and affixed thereto. While it is preferable to develop the electrostatic latent image with marking material the image may be used in a host of other ways such as, for example, "reading" the latent image with an electrostatic scanning system.

When the photoreceptor device of the present invention is to be reused to make additional reproductions, as is the case in a recyclable xerographic apparatus, any residual charge remaining on the photoreceptor after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor, while the photoconductive carrier generating layer is uniformly illuminated and grounded. For example, charge removal can be effected by A.C. corona discharge in the presence of illumination from a light source, or preferably a grounded conductive brush could be brought into contact with the surface of the photoreceptor in the presence of such illumination. This latter mode also will remove any residual toner particles remaining on the surface of the photoreceptor.

The invention will now be described in detail with respect to specific preferred embodiments thereof, it being understood that these examples are intended to be illustrative only and the invention is not intended to be limited to the materials, conditions, process parameters and the like recited herein. All parts and percentages are by weight unless otherwise indicated.

EXAMPLE I

A photoresponsive device was prepared by sequentially evaporating several discrete inorganic layers onto a 5 mil abraded and etched aluminum substrate in a standard vacuum coater at a background pressure of $1\text{-}2\times10^{-4}$ Torr, millimeters of Hg.

The aluminum substrate was first heated to 110°-119° C. and while held in this temperature range high purity selenium was deposited thereon from a stainless steel boat whose temperature was raised from 25°-330° C. over a period of 13 minutes. Upon contact with the heated substrate the condensing selenium vapors immediately formed a trigonal selenium layer of about 3 micron thickness. The substrate temperature was then decreased to 65°-80° C. in preparation for the subsequent depositions.

The transport layer was then formed by depositing onto the trigonal selenium layer, from another crucible, a 60 micron layer of selenium arsenic alloy of the composition 0.33 percent arsenic, 20 parts per million chlorine and 99.6 percent selenium. During this step the substrate temperature was maintained at 65°-70° C., the alloy crucible temperature was increased from about 25 to about 290° C., and the evaporation was completed in 27 minutes.

With the substrate temperature in the range of 66°-67° C., the generator layer was then deposited on top of the transport layer. Pressed pellets of a powdered selenium tellurium alloy, 75 percent selenium, 25 percent tellurium were evaporated over a period of 11 minutes from the crucible whose temperature was increased from 190° to 405° C. A 0.3 micron layer of selenium tellurium alloy resulted. The above three layered structure was then overcoated with an 18 micron layer of Vitel, a polyester resin (commercially available from Goodyear Chemical Company) by conventional solution spraying techniques.

EXAMPLE II

A photoresponsive device was prepared in essentially the same manner as in Example I with the exception that a cylindrical aluminum tube, approximately $4\frac{5}{8}$ inch diameter × 16 inch long, was used as the substrate, the transport material was comprised of an alloy consisting of 0.12 percent arsenic 87 parts per million chlorine, and 99.9 percent selenium, the generating layer was 0.6 microns in thickness, and the overcoating layer was a polyurethane material instead of a polyester.

EXAMPLE III

A photoresponsive device was prepared in essentially the same manner as in Example I, with the addition that a trapping layer, 0.1 microns in thickness, was formed on top of the selenium tellurium generating layer. The trapping layer was prepared by evaporation of a weighed amount of an alloy comprised of 0.33 percent arsenic, 20 parts per million chlorine, and 99.6 percent selenium, from a heated crucible in a separate evaporation step.

The trigonal selenium injector layer was formed by evaporation of selenium from a heated crucible as in Example I. This crucible from which the selenium has been evaporated is charged with an amount of the above alloy calibrated to result in a deposited thickness of 0.1 micron. Additionally, there were used two other crucibles, (as in Example I), one crucible containing the material for the transport layer, and the other containing the material for the generator layer, and the materials from these crucibles were evaporated as accomplished in Example I. Following this the temperature of the crucible containing the material for the hole trapping topcoat layer was raised from about 175° C. to about 340° C., and evaporation was accomplished over a period of about 3 minutes. The completed four layer device, comprised of a hole injector layer, overcoated with a transport layer, which in turn is overcoated with a generator layer, and finally a hole trapping layer, was overcoated with a polyester resin (Vitel), 15 microns in thickness.

EXAMPLE IV

A photoresponsive device was prepared in essentially the same manner as in Example II with the exception that a topcoat hole trapping layer was formed over the generator layer by a re-evaporation technique. During evaporation of the transport layer and the generator layer, the trigonal selenium crucible (from which the injector layer material had been evaporated), was allowed to remain at ambient temperature, namely, the temperature of the coating apparatus. During this period its temperature increased from about 35° C. to about 80° C. and a small quantity of the transport layer material deposited thereon is used to make the injector layer. (In distinction, in Example II, this empty crucible was maintained at about 250° C. during the transport and generator evaporations so that no material condensed thereon).

After deposition of the generator layer the temperature of the aforementioned crucible was increased from 80° C. to about 415° C., thereby evaporating the small quantity of deposited trapping material and condensing it on top of the generator layer thereby forming the hole trapping layer top coat of 0.01 microns thickness.

When the photoresponsive devices of Examples III, and IV were used to form images using the double charging imaging process described in detail hereinbefore (reference FIGS. 2A–2C), there resulted images of good quality and high resolution comparable to images formed with conventional photoreceptors, using known xerographic imaging methods, single charging. The comparisons were based onvisual observations.

Although this invention has been described with respect to certain preferred embodiments, it is not intended to be limited thereto, rather those skilled in the art will recognize that variations and modifications may be made therein which are within the spirit of the invention and the scope of the claims.

What is claimed is:

1. A layered inorganic photosensitive device which comprises (a) a substrate;

(b) a layer of hole injecting material capable of injecting holes, this layer being comprised of trigonal selenium, the hole injecting layer having a thickness of from about 0.5 microns to about 10 microns;

(c) a hole transport layer in operative contact with the hole injecting layer, this layer being comprised of a halogen doped selenium arsenic alloy, where in the percentage by weight of selenium present is from about 99.5 percent to about 99.9 percent, the percentage by weight of arsenic present is from about 0.1 percent to about 0.5 percent, and the halogen is present in an amount of from about 10 parts per million, to about 200 parts per million, the hole transport layer having a thickness of from about 5 microns to about 60 microns;

(d) a charge generating layer overcoated on the hole transport layer comprised of an inorganic photoconductive material, the charge generating layer having a thickness of from about 0.1 microns to about 5 microns;

(e) a hole trapping layer contained on the generating material, the hole trapping layer being comprised of a halogen doped selenium arsenic alloy wherein the amount of selenium present by weight ranges from about 95 percent to about 99.9 percent, the amount of arsenic present ranges from about 0.1 percent to about 5 percent, and the amount of halogen present ranges from about 10 parts per million to 200 parts per million, the hole trapping layer having a thickness of from about 0.01 microns about 5 microns, and;

(f) a layer of electrically insulating organic resin overlaying the hole trapping layer.

2. A layered inorganic photosensitive device in accordance with claim 1 wherein the substrate is conductive, the charge generating layer is comprised of a selenium tellurium alloy, the hole trapping layer is comprised of a halogen doped selenium arsenic alloy wherein the amount of selenium present by weight is 99.9 percent, the amount of arsenic present by weight is 0.1 percent, and from about 50 parts per million to about 100 parts per million of the halogen chlorine, and the insulating organic resin overcoating is a polyester material.

3. A layered inorganic photosensitive device in accordance with claim 1 wherein the substrate is aluminum, the selenium arsenic hole trapping layer is comprised of 99.9 percent selenium and 0.1 percent arsenic, and 50 parts per million to 100 parts per million of halogen, and the insulating organic overcoating resin is a polyurethane material.

4. A layered inorganic photosensitive device in accordance with claim 1 wherein the thickness of the substrate layer ranges from about 5 mils to about 200 mils, and the thickness of the electrically insulating overcoating resin ranges from about 5 microns to about 25 microns.

* * * * *